United States Patent [19]

Saylor et al.

[11] 4,067,006

[45] Jan. 3, 1978

[54] CHANGEABLE ALPHANUMERIC SIGN WITH OPAQUE TAPE DISPLAY FORMING SEGMENTED CHARACTERS AND WORDS

[75] Inventors: William H. Saylor, South Laguna; James O. Narey, Westminster, both of Calif.

[73] Assignee: Associated Data Concepts, Costa Mesa, Calif.

[21] Appl. No.: 637,434

[22] Filed: Dec. 3, 1975

Related U.S. Application Data

[63] Continuation-in-part of Ser. No. 546,696, Feb. 3, 1975, abandoned.

[51] Int. Cl.[2] ..... G09F 11/18

[52] U.S. Cl. ..... 340/325; 40/467; 40/471; 340/324 R; 340/379; 340/334; 40/519

[58] Field of Search ..... 340/324 B, 325, 334, 340/379; 40/31, 52 R, 46, 93, 92, 117, 82–86, 117, 347, 106.51, 106.52, 106.53

[56] References Cited

U.S. PATENT DOCUMENTS

| | | | |
|---|---|---|---|
| 1,016,944 | 2/1912 | Kent | 40/31 |
| 1,553,302 | 9/1925 | Allatt | 40/93 |
| 1,872,145 | 8/1932 | Hurford | 40/93 |
| 2,754,500 | 7/1956 | Lazich | 340/324 B |
| 2,764,827 | 10/1956 | Custin | 40/93 |
| 3,582,937 | 6/1971 | Dozer | 340/324 B |

*Primary Examiner*—Marshall M. Curtis

*Attorney, Agent, or Firm*—Reising, Ethington, Barnard

[57] ABSTRACT

A changeable alphanumeric sign with printed characters is disclosed. The sign is universally changeable in the sense that any combination of alphanumeric characters may be displayed by selectively positioning a set of display tapes in each character window. Each set of tapes forms a broken-character display in the respective character window and all character windows are independently controlled to form a broken-word display. This arrangement minimizes the length of display tapes required. An open-loop positioning system is provided whereby all sets of tapes are concurrently but independently positioned to change the characters of the sign.

6 Claims, 10 Drawing Figures

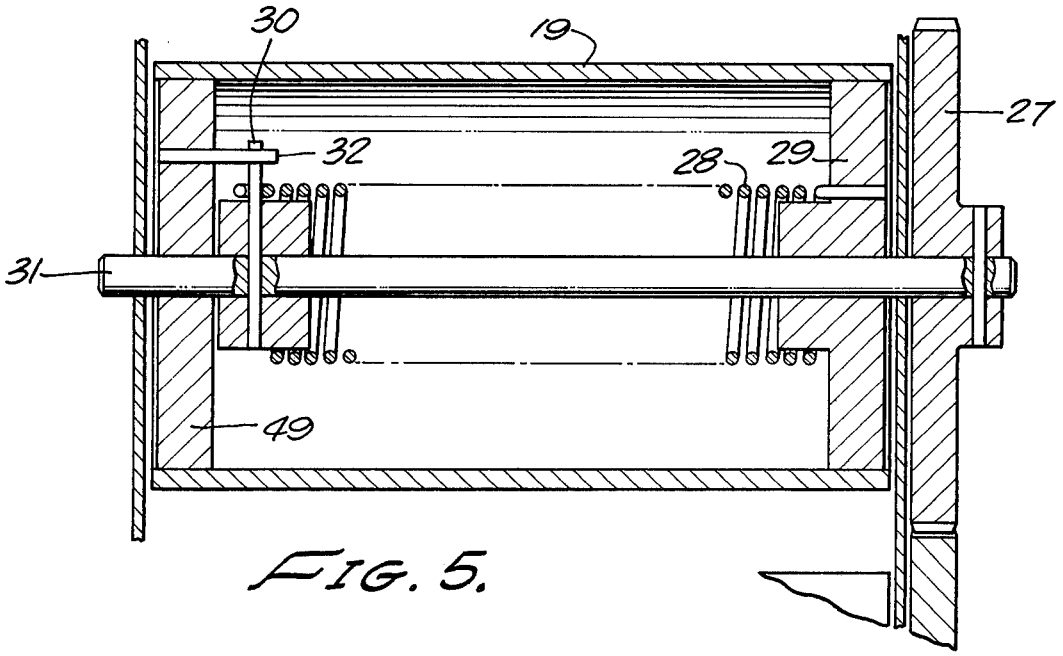
FIG. 5.
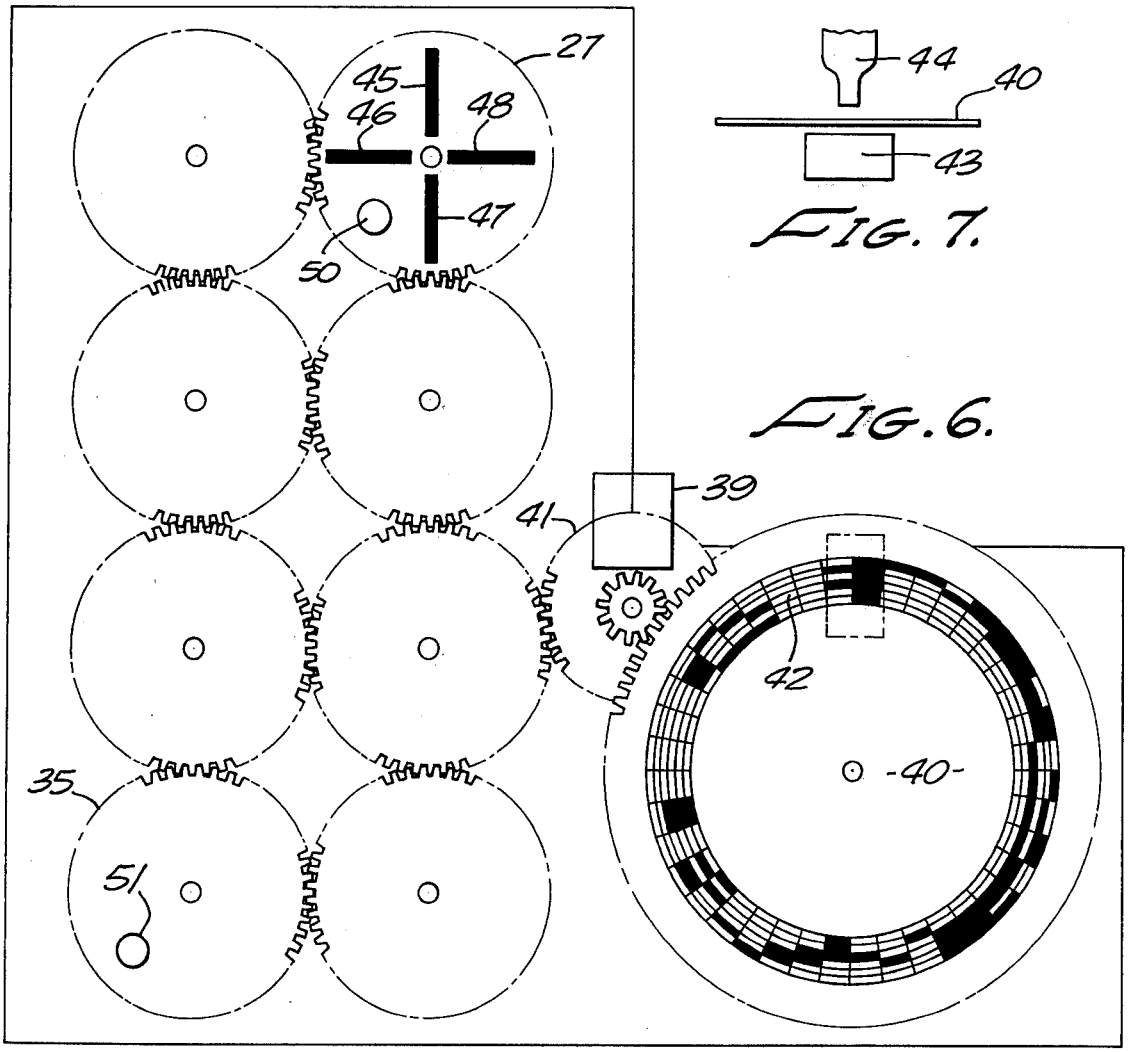
FIG. 7.
FIG. 6.

CHANGEABLE ALPHANUMERIC SIGN WITH OPAQUE TAPE DISPLAY FORMING SEGMENTED CHARACTERS AND WORDS

This is a continuation-in-part of patent application Ser. NO. 546,696 filed Feb. 3, 1975 now abandoned.

FIELD OF THE INVENTION

This invention relates to information displays and particularly to such displays as are capable of presenting any of a number of alphanumeric displays.

BACKGROUND OF THE INVENTION

The problem of presenting a readily changeable alphanumeric readout in a small space has been solved in many different fashions, as exemplified by neon-glow-discharge tubes, liquid crystal readouts, solid-state electroluminescent devices, and the like. Most such arrangements require operating signals which themselves contain most or all of the information to be displayed, and in any case are in general poorly adapted to large scale readouts, such as may be seen readily from a considerable distance. Further, a general problem with light-emitting displays is illegibility when the ambient light level is high. Opaque displays, in contrast, increase in visibility as the ambient light increases.

A need exists for a mechanically sound, readily and quickly changeable and accurate display for such diversified uses as destination indicators for buses, advertising signs, indicators of ambient temperature, time of day, and the like.

THE PRIOR ART

In the prior art, opaque roller-curtain type destination signs are illustrated in the Pierce U.S. Pat. No. 354,929 and in the Morrone U.S. Pat. No. 1,196,136. The display devices of these patents use a single roller curtain with a large number of place names printed thereon. This type of curtain requires a special printing of destination names for each route. Furthermore, a relatively long curtain is required to accommodate a large number of place names. It is noted that the devices of the aforementioned patents have both surfaces of the curtain imprinted with the place names.

An advertising display apparatus with plural roller curtains forming a segmented picture is described in the Kent U.S. Pat. No. 1,016,944. This apparatus uses roller curtains as wide as th entire picture to be displayed. Each roller curtain may provide two segments of the picture by imprinting both surfaces of the roller curtain which extends between driving and driven rollers with each segment being looped over a pair of display rollers. A similar apparatus for exhibiting pictures is shown in the Swedish Pat. No. 42,928. The roller curtains of this apparatus are presumably as wide as the picture and are imprinted on one side only. Alphabetic characters are shown in a segmented display. It is noted that a pair of curtains is wound upon each set of driving and driven rollers and plural driving rollers, and hence curtain pairs, are driven in unison by a common driving shaft. Such a set of curtain pairs carry the segments for parts of two alphabetic characters and hence curtain segments or parts making up one character cannot be changed without changing the curtain parts making up the other character.

An alphanumeric display sign having multiple character window areas is disclosed in the Dozer U.S. Pat. NO. 3,582,937. A separate tape bearing a set of characters is provided in each window area, each character being shown in its entirety. The tape is movable to display selectively any one of the characters imprinted on the tape. The tapes are automatically repositioned by a closed-loop control system in response to a coded input such as a punch card.

Other prior art is represented by the following U.S. patents:

| | |
|---|---|
| Knight | 388,980 |
| Farrand | 762,519 |
| Tatosian | 1,301,620 |
| Archipenko | 1,262,497 |
| Hoetger | 1,764,683 |
| Morrison | 1,894,960 |
| Llobet | 3,299,551 |
| Piper | 3,389,483 |
| Mobet | 3,585,745 |

The prior art is further represented by Italian Pat. No. 527,977.

SUMMARY OF THE INVENTION

An object of the present invention is to provide a readily changeable display device adapted to displaying letters, numerals, words and phrases and the like within the framework of a mechanically sound apparatus.

Another object of the invention is to provide such a device including positioning means whereby the display may be selectively changed to any desired configuration, and is especially well adapted to positioning by automatic devices, particularly those under computer or machine control.

A particular application of the subject invention is in the field of destination signs for transit vehicles such as buses and trains. Such destination signs must be changeable according to the particular route of the vehicle and, in modern day transit systems, each sign must be capable of displaying a large number of different destination names in alphanumeric form. A typical destination name may require forty or more characters and the sign must be changeable quickly from one name to another. In the past, destination signs have taken the form of a roller curtain wide enough to accommodate the requisite number of characters and long enough to hold a full set of destination names required for a given vehicle. One great difficulty with this type of destination sign is that the roller curtains must be printed with special destination names according to the route of a particular vehicle or fleet of vehicles. This requires the printing of a large number of different destination signs for a given metropolitan area with attendant high cost. Furthermore, with long sing curtains, it is difficult and expensive to provide automatic sign changing systems.

The roller curtain destination sign, despite the above-mentioned difficulties, has an exceedingly important attribute, namely, it affords excellent readability despite wide variations in ambient light. Further, it lends itself to large scale displays so the sign can be read from a distance. As alluded to above, the roller curtain destination sign in the form of an opaque display, is presently preferred for destination signs over all other known displays.

This invention seeks to take advantage of the readability of an opaque display and to overcome the difficulties of the roller curtain destination sign. In general, this is accomplished by a sign having a plurality of window areas each of which is adapted to display one alphanumeric character at a time on a set of display tapes; each window area is capable of selectively displaying any one set of characters by selectively positioning the respective tapes of the set. Thus, a selected destination name may be displayed by selective positioning of the sets of tapes.

This scheme allows any destination name to be formed and displayed using identical sets of character display tapes for each character window area. Thus, the same set of character display tapes may be produced in multiple copies to make up a destination sign and the same destination sign may be used on any route since any destination name may be formed by the sign.

To make practical this concept of a universal destination sign, this invention provides a broken-character, broken-word arrangement. The broken-character utilizes plural display tapes to form each character rather than a single tape showing all characters in succession; by this technique, each tape is shortened to a fraction of the length of the single tape. Therefore the wrap-up of the tapes is minimized and the maximum displacement of any tape to form any character is a fraction of that required in the case of a single tape. The broken-word arrangement utilizes the tapes in each set which are only one character wide and which are used for only one window area. The tapes of each set are positionable independently of the tapes of any other set; this enables the number of character portions disposed along the length of each tape to be kept at an absolute minimum (since the tape is only one character wide and no pairs or combinations of character portions are involved laterally). This arrangement allows the sets of tapes to be displaced simultaneously to form their respective characters.

The invention is realized in a sign having plural window areas each adapted to display a single character with portions of the character allocated to discrete window segments. Plural sets of display tapes are disposed at respective window areas for collectively forming any character at a time. Each tape has character segments imprinted thereon in a predetermined order at discrete segments of the tape along the length thereof with the number of character segments being equal to the number of characters to be displayed and each character segment corresponding to that segment which is to occupy the corresponding discrete window segment when the character is displayed. Movable support means are provided for supporting each set of tapes so that a selected segment of each tape can be seen at a time in each discrete window segment. A separate clutch means connects each movable support means with a common motor and the clutch means are selectively actuated for concurrently but independently displacing all sets of display tapes to change the plural character of the sign.

DETAILED DESCRIPTION

A more complete understanding of this invention may be obtained from the following description, taken with the accompanying drawings in which.

Figure 3A:
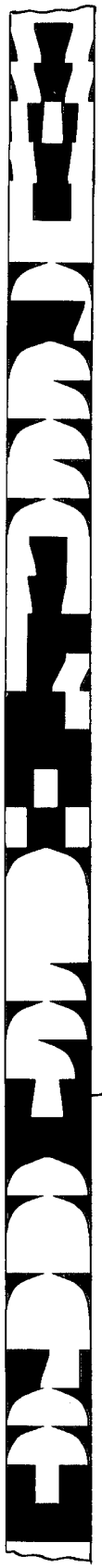
Figure 3B:
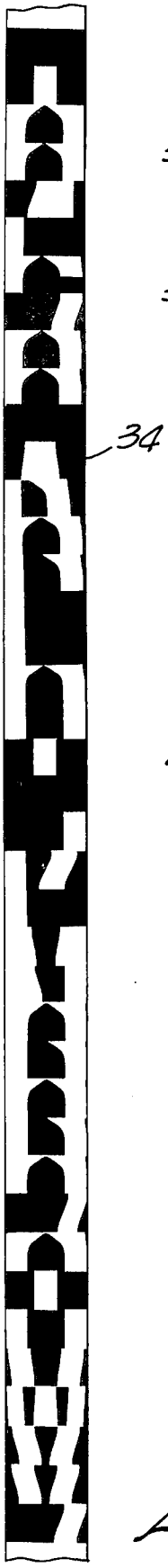
Figure 4:
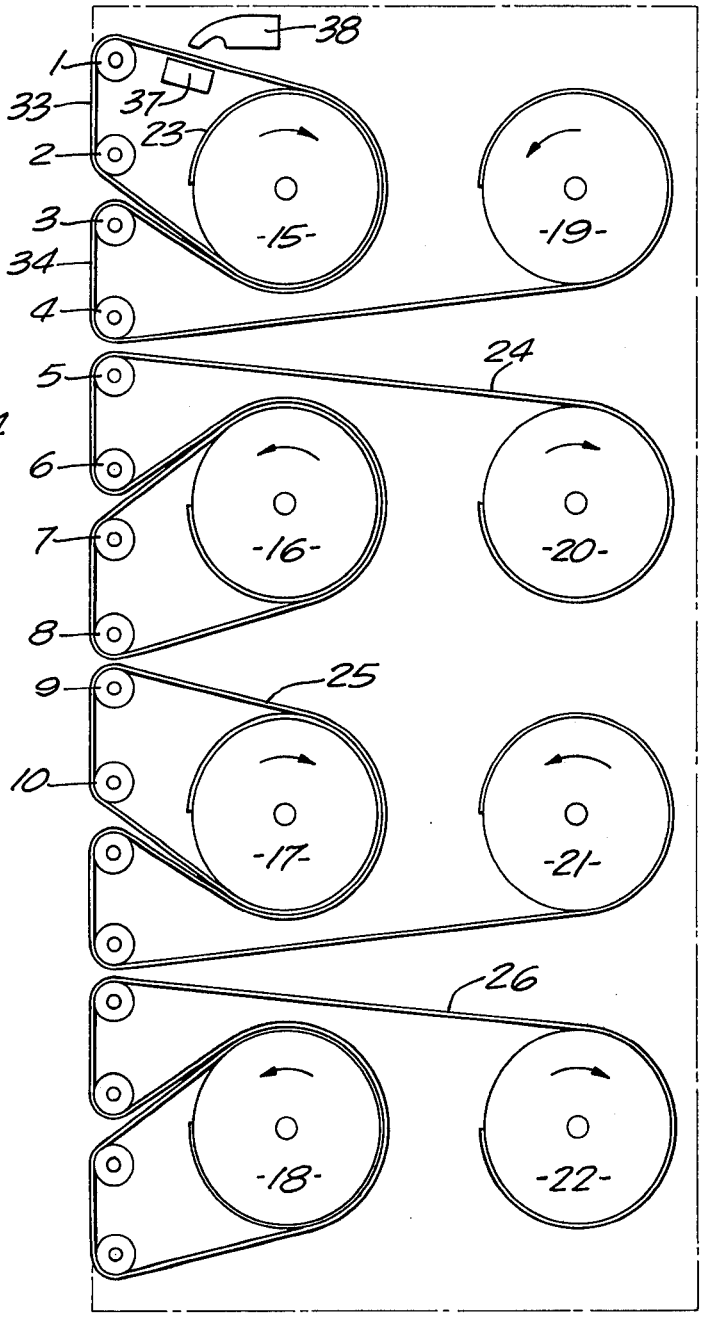
Figure 8:
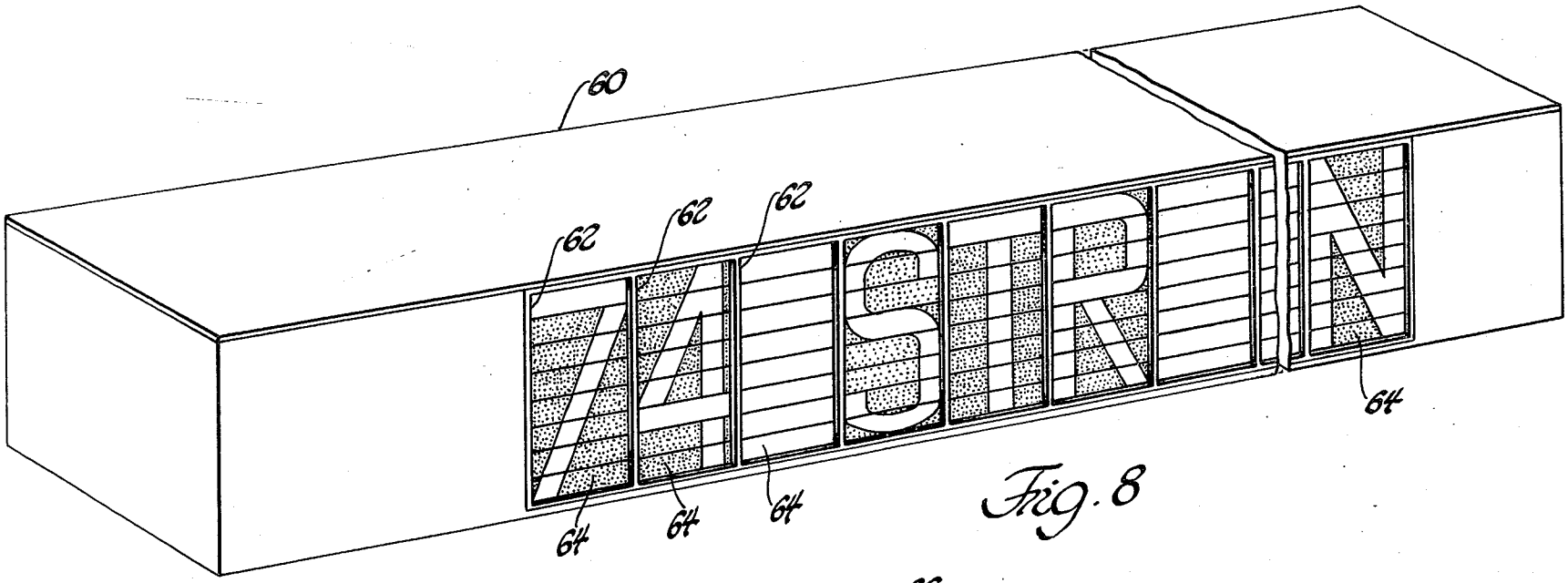

FIGS. 3*a* and 3*b* are respectively the front and back sides of a display tape such as may be used in the device;

FIG. 4 is a diagrammatic side view of the device showing the winding mode of the display tape on the rollers:

FIG. 5 is a sectional view showing the detailed construction of a slave roller;

FIG. 6 is a diagrammatic side view showing the intermeshing coupling means whereby the driving rollers are rotated and showing an optional positioning code disc;

FIG. 7 is a top fragmentary view of the code disc shown in FIG. 6;

FIG. 8 shows a destination sign according to this invention, and

Figure 9:
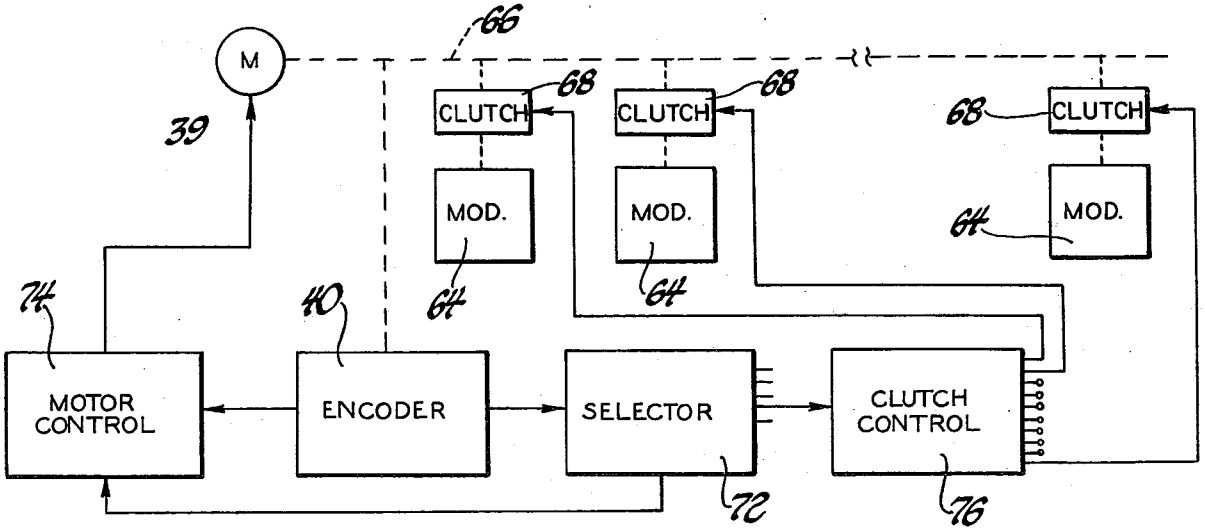

FIG. 9 shows a positioning control system for use in this invention.

Figure 2:
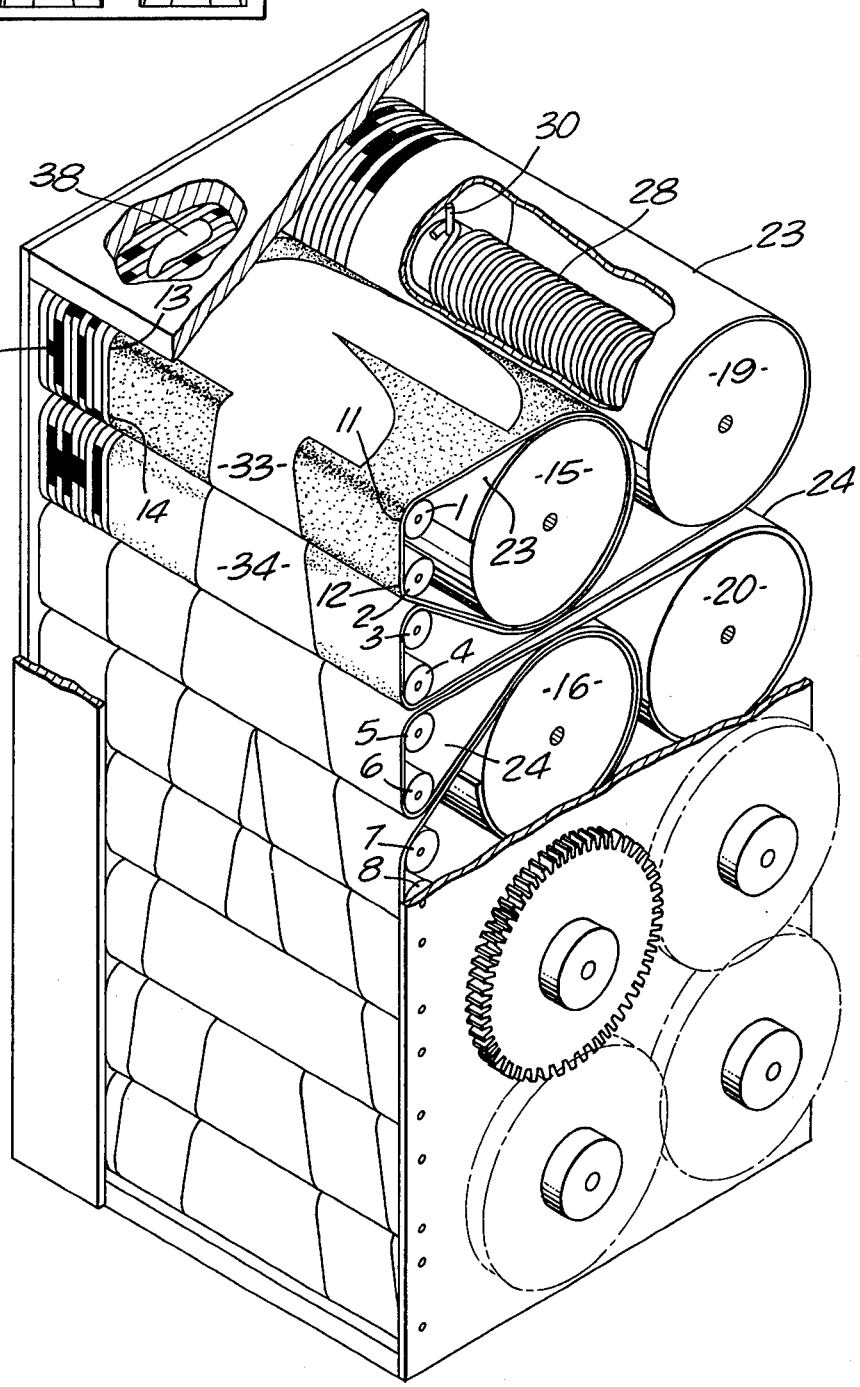
FIG. 2 is a partially cut-away perspective view of a typical embodiment of the inventive display unit.

Coming now to FIGS. 2 and 4, it will be seen that the device comprises an array of display rollers, 1, 2, 3, 4, 5, 6, 7, 8, 9, 10, etc., which are arranged in spaced pairs, 1,2; 3,4; etc., and in which two adjacent pairs form groups of four rollers each, such as 1–4 inclusive, 5–8 inclusive, and so forth. Furthermore, all of the axes of the cylindrical display rollers 1, 2, 3, etc., are in the same plane so that all of the cylindrical display rollers are tangent to a display plane, the position of this tangent display plane being indicated in the drawings by those segments of the tapes which lie flat on the front of the display device, as shown, for example, in FIG. 2 by that portion of the uppermost tape lying between the points indicated as 11, 12, 13 and 14.

Figure 1:
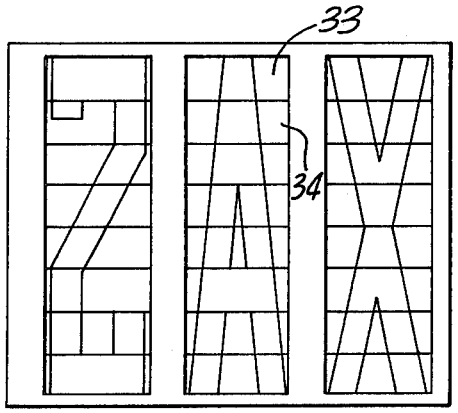
FIG. 1 is a front view of three display units in accordance with the invention, each exhibiting a different numeral or figure.

It will be apparent from the drawings and in particular from FIGS. 1 and 2 that those portions of the display tapes visible from the outside form an array of essentially horizontal segments which may be viewed as a whole, thus for example in FIG. 2 displaying the letter "A" made up of eight horizontal segments.

Reverting now to FIG. 4, this illustrates the fashion in which the tapes are wound on and over their respect rollers. Each group of four display rollers, 1–4, 5–8, 9–12, etc., is backed up by a driving roller 15, 16, 17 and 18, and by a slave roller 19, 20, 21 and 22. A tape 23 is fastened at one end to the driving roller 15, and after looping over the back of the driving roller is threaded over display rollers 2 and 1 and thence back over driving roller 15 and thence is threaded over display rollers 3 and 4 and is finally take up by slave roller 19, to which its opposite end is fastened.

It will be observed that in passing over display rollers 1 and 2, one face of the tape 23 is exposed to view, whereas when the tape passes over display rollers 3 and 4 the back or reverse side of the same tape is displayed.

It will be further noted that the next unit in the stack comprising display roller 5, 6, 7 and 8, driving roller 16 and slave roller 20, has its own tape 24. The same is true for the remaining units in this stack involving driving rollers 17 and 18, slave rollers 21 and 22, and tapes 25 and 26 respectively. Further, proceeding from the top of the stack downward each successive driving roller together with all the rollers actuated thereby rotates in a sense opposite to that of its neighbor next below, for reasons which will appear later.

In the embodiment shown in the drawings, four units are shown in a vertical stack. It will be clear that more or fewer could be used in accordance with the nature of the information to be displayed. Likewise, FIG. 1 shows three such four-stack arrays in horizontal juxtaposition. This enables the information on each of the three devices to be varied independently of the others, which in some instances is advantageous, as for example when various numbers or various words are to be shown. Clearly, if for example 20 devices are assembled in a horizontal array and if each device can display each of the 26 letters of the alphabet and the 10 digits from 0 to 9, then any word of up to 20 letters or any digit up to $1 \times 10^{20} - 1$ can be displayed at will.

Reverting once more to the drawings, the slave rollers 19, 20, 21 and 22 are take-up rollers which serve to wind up, or as the case may be, to unwind the tape when the display is changed. All of the driving rollers 15, 16, 17 and 18 and the slave rollers 19, 20, 21 and 22 are geared together as may be seen from FIG. 6, and because of the relative sense of rotation of the various rollers this may be done in the extraordinarily simple fashion shown in FIG. 6. Thus, all of the gears are meshed together at their points of contact, which leads to a complete avoidance of any slippage problems which might otherwise cause the tapes in a given stack to become out of phase. As a given tape is wound from its driving roller onto its slave roller, or contrariwise, it will be clear that a given amount of angular rotation will correspond to a slightly varying linear payout or uptake because of the finite thickness of the wound tape. We compensate for this slight disparity in the required angular rotation between a given driving roller and its slave roller by providing a spring loading in torque for each slave roller, as may be seen from FIG. 5. It will be clear from that drawing that the gear 27 does not drive the roller 19 directly and positively but only through the intermediary of helical spring 28, which is set so as to impart a moderate degree of tension in the tape. Spring 28 is engaged at one end to endpiece 29 forming part of the slave roller 19; whereas the other end it engages anchor pin 30 which is fixedly attached to the drive shaft 31 which in turn is fixedly attached to gear wheel 27. A stop pin 32 is attached to endpiece 49 of slave roller 19, and serves to limit the rotation of shaft 31 with respect to slave roller 19. It serves to hold the spring 28 from being overstressed during operation if the tape or roller should stick. The arrangement of course is repeated for each unit in the stack.

It will be clear from the foregoing, and particularly from FIG. 2, that the array of gears attached to the driving rollers are not only intermeshed with each other, but are also intermeshed with th array of gears which are attached to the slave rollers, and both arrays are intermeshed so that all of the gears may only rotate in unison, taking into account the opposite senses of rotation of adjacent gears. Thus each driving roller gear engages at least one other driving roller gear as well as its corresponding slave roller gear; and the same may be said for each of the slave roller gears, each one of these engaging at least one other slave roller gear while at the same time engaging its corresponding driving gear.

Turning for the moment to FIGS. 3*a* and 3*b*, these show respectively the front and back sides of tape 23, which as will be appreciated from the foregoing explanation has, depending upon the particular setting of the device, a segment of one side displayed between display rollers 1 and 2, and another segment from the other side displayed between the display rollers 3 and 4. FIG. 1 shows the setting of the device so as to display the letter "A". In FIG. 3*a*, that segment forming the top half of the upper one-quarter of the letter "A" is indicated by 33; whereas that portion of the reverse of the tape shown on FIG. 3*b* which forms the lower half of the uppermost one-quarter of the letter "A" is indicated by 34. The tape shown in FIGS. 3*a* and 3*b* bears sufficient markings to form the upper one-quarter portion, that is, between rollers 1 and 4, of all 26 letters of the alphabet, all 10 digits from 0 through 9, a period (.), a dash (-), a slash (/), and a blank space.

It may be remarked that for convenience in explaining our invention we have shown the various rollers as horizontal with the stacking vertical; but the terms "horizontal" and "vertical" are used mainly for convenience. It is self-evident that the entire apparatus shown may be rotated through 90°, so that the rollers will then be vertically disposed. Obvious changes will then have to be made in the arrangement of the subject matter to be displayed, except in the infrequent case that the material consists of symbols having four-fold symmetry such as circles, plus signs, crosses of equal arm length and the 1, 4 and 5 spots on dice and the like.

As already noted, the display is shifted to a new position by the rotation of any of the driving or slave rollers by one-quarter turn, that is, by 90°, for the relative proportions of the particular apparatus depicted in the drawings. Of course, it is a simple matter to change the ratio of the diameter of the driving and slave rollers to the spacing distance between a single display roller pair so as to vary the amount of rotation required to produce a new setting in display. We find the ratios shown and described to be best, however, for it leads to a comfortable amount of working space behind the display rollers. On FIG. 6, four index marks 45, 46, 47 and 48 are shown on the face of gear 27, and it will be clear from the foregoing that the display can be changed by rotating the driving/slave gear assembly by 90°. This may readily be done by hand with the aid of either knob 50 on the face of gear 27 or knob 51 on the face of gear 35. Exact positioning is facilitated by observing the four index markings on the face of gear 27. Remote control of rotation may of course be effected by any of the means well known to those skilled in the art, such as by the use of cables, pulleys and the like.

Such repositioning of the display by hand is adequate in many cases where the destination is changed infrequently or where only two or three display devices are used, as in FIG. 1. In many other cases, however, it is desirable to be able to reposition the display device automatically. In a destination sign for buses where a large number of characters are displayed, an automatic system is desirable. A destination sign, as shown in FIG. 8, comprises an enclosure or case 60 which is provided with a plurality of windows 62 which display respective alphanumeric characters making up a destination name. A sign module 64 is positioned within the case 60 behind each window 62 so as to present its character display through the window.

A closed-loop positioning system may be employed for automatic selection of the desired character display. In the device of FIGS. 2 and 4, the uppermost tape 23 bears a coded endstrip 36 in the portion shielded from view. This strip bears positioning markers in an array of parallel channels, the markings consisting of opaque portions in an otherwise transparent or translucent tape. The momentary position of tape 23 is registered by an optical code sensor 38 which may conveniently comprise a light source 37 and a multiple photodiode or like receptor means, none of which requires to be set forth in any detail since this general type of coded positioning sensing and registration is well known in the art. The signal given by sensor 38 is used to actuate a drive motor 39 (see FIG. 6), which again is a matter of well-known technology. It is of course necessary to provide more than one of the display tapes with the coded edge portion since all of the tapes are in effect geared together and move simultaneously as already described. As is conventional in closed-loop positioning systems, a command signal is applied to the input according to the positioning desired, i.e. according to the character to be displayed. The command signal causes the drive motor 39 to be energized. The tapes are displaced in unison and the sensor 38 continuously produces a follow-up signal corresponding to the actual positioning of the tapes. The follow-up signal is compared with the command signal and when correspondence or equality is achieved, the motor is stopped and the selected character is displayed by the tapes. In a closed-loop system, precise positioning of the tapes may be achieved since the positioning code is applied to the tape itself and may be positionally correlated with the respective character segments distributed along the length of the tape. While positioning of the tapes by use of a closed-loop positioning system does circumvent certain positioning problems, it is disadvantageous in certain respects. In particular, where two or more modules are to be used together and adapted to display different characters, it is necessary to use a separate positioning system for each display device. Furthr, in a closed-loop system a failure in locating the correct positional code signal will result in the display of a wrong or garbled character, or perhaps, damage to the device. As will be discussed below, an open-loop type of positioning system is preferred and the display device of this invention is adapted for such positioning.

For changing the display from one character to another, an open-loop control system is preferred. For this purpose, it is desirable that succeeding characters may be selected by advancing or reversing the tapes through equal increments of angular displacement of the driving rollers. This will enable two or more display modules to be operated from a single drive motor with individual clutches for each module. However, because the tape is wrapped in varying amounts on the rollers according to the tape positioning, the effective roller diameter varies and a given angular displacement of a roller does not correspond to the same lineal displacement of the tape. In the illustrative example, the relative dimensions have been chosen so that the effective diameter of the driving roller is such that one-fourth of a revolution forward from its home or reference position will take up a length of the tape equal to the axial length of each window segment. (In this home position, the effective diameter includes the roller diameter plus any tape leader wound thereon.) Accordingly, the first revolution of the roller will take up the first four character segments. However, during the next revolution the roller will have an effective diameter which is larger by twice the thickness of the tape and will take up a length of tape greater than the next four character segments. The effective diameter of the roller continues to increase with approximately each succeeding group of four character segments. Thus, it can be seen that as the tape is advanced or taken up further on the driving roller, each 90° increment of roller rotation will take up slightly more tape than the previous increment. So that equal angular increments of roller displacement will provide accurate positioning of successive character segments, the character segments are nonuniformly spaced along the length of tape. This arrangement is disclosed in our copending patent application Ser. No. 637,433, filed on even date herewith, which is hereby incorporated by reference in this application.

An open-loop positioning system which is especially adapted for a destination sign is illustrated in FIG. 9. Each of the sign modules 64 in this system is the same as that shown in FIG. 2 except that the coding strip 36 and the sensor 38 are omitted. For the open-loop positioning system, a shaft position encoder 40, as shown in FIG. 6, is geared to the drive shaft for the display devices. As noted in FIG. 6, the drive motor 39 drives each display device through a drive gear 41 and also drives an encoder 40 through a pinion gear on the same shaft. The shaft position encoder 40 bears an annular coding strip 42. The coding strip coacts with a light source 43 and an optical sensor 44, as depicted in FIG. 7, to produce an electrical signal corresponding to the angular position of the driving shaft.

The open-loop positioning system is shown in block diagram in FIG. 9. The motor 39 is a reversible electric motor and is provided with an elongated drive shaft 66 mechanically coupled with the encoder 40. Each of the display modules 64 is separately coupled with the drive shaft 66 through a respective clutch 68. A selector means 72 is adapted to produce an electrical signal corresponding to the desired positioning for each of the modules 64. The selector means 72 receives an input signal from the encoder 40 which is indicative of the actual positioning of the motor shaft 66. The encoder 40 also provides a position signal to a motor control means 74 which controls the energization of the motor 39. The output of the selector means 72 is connected with the input of a clutch control means 76 which supplies individual control signals to the respective clutches 68. In operation, the selector means 72 is set according to the desired position for each of the display modules. This setting initiates the energization of the motor 39 through the motor control means 74 which causes the motor to drive all of the display devices in the reverse direction to a home position. The motor is automatically reversed by the motor control means upon reaching the home position and the clutches are selectively engaged and disengaged through the clutch control means 76 so that each display module is positioned according to the setting of the selector means. Thus the display modules 64 are controlled independently and are driven concurrently from the home position to the respective display positions.

Although the description of this invention has been given with reference to a particular embodiment it is not to be construed in a limiting sense. Many variations and modifications will now occur to those skilled in the art. For a definition of the invention, reference is made to the appended claims.

The embodiments of the present invention in which an exclusive property or privilege is claimed are defined as follows:

1. A changeable sign formed of plural alphanumeric characters, said sign comprising: plural window areas each adapted to display only a single character with discrete segments of the character allocated to discrete window segments of the window area, plural sets of display tapes, each set of display tapes being disposed at a different one of said window areas for collectively forming any of said characters one at a time, each tape having character segments imprinted thereon in a predetermined order at discrete parts of the tape along the length thereof, the number of character segments corresponding to the number of characters to be displayed and each segment corresponding to that portion of a character which is to occupy the corresponding discrete window segment when the character is displayed, movable support means for supporting each set of tapes so that only one of said tape segments can be seen at a time at each discrete window segment, with all segments of a selected character displayed together in the respective window area, each tape being one character wide and the plural sets of display tapes being arranged side-by-side so that plural characters can be displayed side-by-side whereby a word is formed by selectively positioning each set of tapes, a motor, a separate clutch means connected between said motor and the movable support means of each set of display tapes, and means for selectively actuating said clutch means for concurrently but independently displacing all sets of display tapes to change the characters of the sign.

2. The invention as defined in claim 1 wherein each tape has character portions imprinted on both surfaces and said support means for supporting each tape includes a first set of rollers for displaying one surface of the tape and second set of rollers for displaying the other surface of the tape.

3. The invention as defined in claim 1 wherein said movable support means for supporting each set of tapes includes a driving roller and a slave roller for each tape with one end of the tape attached to the driving roller and the other end of the tape attached to the slave roller, the clutch means associated with a set of display tapes being connected with one of said rollers, and means coupling the rollers of one tape in a set to the rollers of the other tapes in the same set for rotation in unision.

4. The invention as defined in claim 3 wherein each tape has character portions imprinted on both surfaces and the number of character portions is equal to twice the number of characters to be displayed.

5. The invention as defined in claim 4 including a group of display rollers for each tape in a set having their axes all in one plane whereby a tangent plane to said rollers defines a display plane, each group including two spaced pairs of rollers, the driving roller and the slave roller of the tape being disposed behind the group of display rollers and parallel thereto, said display tape extending from said driving roller and thence over the first pair of display rollers; back over said driving roller and thence over the second pair of display rollers and thence finally to said slave roller.

6. The invention as defined in claim 5 wherein said means coupling the rollers comprises an array of driving roller gears, each of which is attached to one of said driving rollers and an array of slave roller gears, each of which is attached to one of said slave rollers, each of said driving roller gears engaging at least one other driving roller gear as well as its corresponding slave roller gear, and each of said slave roller gears engaging at least one other slave roller gear whereby both arrays of gears rotate only in unison.

* * * * *

UNITED STATES PATENT OFFICE

CERTIFICATE OF CORRECTION

Patent No. 4,067,006 Dated January 3, 1978

Inventor(s) William H. Saylor and James O. Narey

It is certified that error appears in the above-identified patent and that said Letters Patent are hereby corrected as shown below:
Col. 2, line 53 (Spec. pg 4, line 10), "sing" should be --sign--
Col. 5, line 33 (Spec. pg. 9, line 25), after "whereas" insert --at--. Column 6, line 68 (Spec. pg. 12, line 27), "necessary" should be --unnecessary--. Col. 7, line 26 (Spec. pg. 13, line 18), "Furthr" should be --Further--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*